United States Patent [19]

Soderstrom et al.

[11] Patent Number: 4,971,020

[45] Date of Patent: Nov. 20, 1990

[54] ARCHERY BOW

[75] Inventors: Jim R. Soderstrom; Lloyd S. Napier, both of Sapulpa, Okla.

[73] Assignee: Ben Pearson Inc., Pine Bluff, Ark.

[21] Appl. No.: 320,325

[22] Filed: Mar. 8, 1989

[51] Int. Cl.[5] ..... F41B 5/00

[52] U.S. Cl. ..... 124/23.1; 124/88; 124/900; 124/25.6

[58] Field of Search ..... 124/23 R, 23 A, 24 R, 124/24 A, 25, 88, DIG. 1

[56] References Cited

U.S. PATENT DOCUMENTS

| | | | |
|---|---|---|---|
| 3,486,495 | 12/1969 | Allen | 124/24 R |
| 3,981,290 | 9/1976 | Islas | 124/23 R |
| 4,203,412 | 5/1980 | Rickard | 124/23 R |
| 4,252,100 | 2/1981 | Rickard | 124/23 R |
| 4,337,749 | 7/1982 | Barna | 124/24 R |
| 4,343,286 | 8/1982 | Thacker | 124/24 R |
| 4,457,287 | 7/1984 | Babington | 124/23 R |
| 4,478,202 | 10/1984 | Anderson | 124/23 R |
| 4,662,344 | 5/1987 | Mitchell | 124/88 |
| 4,718,397 | 1/1988 | Remick | 124/23 R |

OTHER PUBLICATIONS

Learn, "Fast Cat," Bow and Arrow, Oct. 1983, pp. 36, 37, 44 and 50.

*Primary Examiner*—Randolph A. Reese
*Assistant Examiner*—Carol I. Bordas
*Attorney, Agent, or Firm*—Walker & McKenzie

[57] ABSTRACT

An archery bow for propelling an arrow at a velocity depending on the draw strength of the bow. The bow includes a handle section having first and second ends; an elongated first limb having a proximal end attached relative to the first end of the handle section, and having a distal end; an elongated second limb having a proximal end attached relative to the second end of the handle section, and having a distal end; a bowstring extending between the distal ends of the first and second limbs; and assist structure for reducing the amount of force required to draw the bowstring to a full draw while maintaining the arrow velocity produced when the bowstring is released.

16 Claims, 3 Drawing Sheets

ARCHERY BOW

BACKGROUND OF THE INVENTION

1. Field of the Invention

The present invention relates, in general, to an improved archery bow that reduces the amount of force required to draw the bow while maintaining the arrow velocity produced by the bow.

2. Information Disclosure Statement

Various bows have been developed in which the maximum force required to draw the bow occurs at a point prior to full draw and then reduces to a lesser value at full draw whereby the bow can be held at full draw with less physical strain as the archer sights and discharges the arrow, etc. Such bows, often referred to as compound bows typically include eccentric cranks or pulleys mounted on the tips of the limbs thereof (see, for example, Allen, U.S. Pat. No. 3,486,495) or between the handle portion of the bow and the bottom of each limb thereof (see, for example, Islas, U.S. Pat. No. 3,981,290). None of the above bows disclose or suggest the present invention.

While typical compound bows reduce the amount of force required to hold the bow at full draw, they do not reduce the amount of force required to draw the bow to full draw while maintaining the arrow velocity produced by the bow. Before the present invention, the only method of reducing the amount of force required to draw a bow to full draw was to reduce the pull weight of the bow by changing the size of the pulleys or the strength of the limbs, etc., which would additionally reduce the arrow velocity produced by the bow.

SUMMARY OF THE INVENTION

The present invention is directed toward providing an improved archery bow that reduces the amount of force required to draw the bow to full draw while maintaining the arrow velocity produced by the bow. For example, when used with an archery bow producing an 80 pound arrow velocity, the present invention could reduce the amount of force required to draw the bow to full draw to, for example, 60 pounds while maintaining the arrow velocity produced by the bow at 80 pounds. The specific reduction in the force required to draw the bow to full draw is variable and depends on the desires of the archer.

An archery bow of the present invention includes, in general, a handle section having first and second ends; an elongated first limb having a proximal end attached relative to the first end of the handle section and having a distal end; an elongated second limb having a proximal end attached relative to the second end of the handle section, and having a distal end; a bowstring extending between the distal ends of the first and second limbs; and assist means for reducing the amount of force required to draw the bowstring to a full draw while maintaining the arrow velocity produced when the bowstring is released.

DESCRIPTION OF THE PREFERRED EMBODIMENT

The archery bow 11 of the present invention is used to propel an arrow (not shown) toward a target (not shown). The force and velocity of the arrow toward the target depends on, inter alla, the "draw pull" of the bow 11. The draw pull of the bow 11 depends on, inter alla, the stiffness of the bow 11, etc., as will be apparent to those skilled in the art. In prior art bows, the force and velocity of an arrow propelled thereby is directly dependent on the draw pull thereof. More specifically, in a prior art bow having a 60 pound draw pull, it takes 60 pounds of force to fully draw the bow and the arrow is propelled at a force and velocity directly based on the 60 pounds of force. With the bow 11 of the present invention, the force and velocity of the arrow propelled thereby is greater than and proportional to the draw pull of the bow 11. Thus, for example, the bow 11 may be designed to have a 60 pound draw pull so that it takes 60 pounds of force to fully draw the bow 11 as indicated by the solid line curve A in FIG. 3 and may be designed so that the arrow is propelled at a force and velocity based on 80 pounds of force as indicated by the broken line curve B in FIG. 3. In other words, the bow 11 may be designed so that the force and velocity that the arrow is propelled thereby is 25% greater than the force required to fully draw the bow 11. It should be understood that the bow 11 may be designed so that the specific difference between the arrow velocity and bow draw pull is greater or lesser than 25%.

Figure 3:
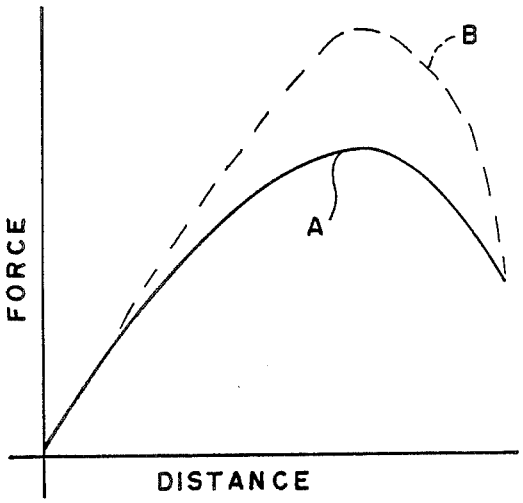
FIG. 3 is a graphic representation showing the relation between the draw weight, arrow velocity and bowstring displacement of the bow of the present invention.

The bow 11 includes a handle portion or section 15 having in general a first end 17 and a second end 19; a first limb 21 having a proximal end 23 for being attached to the first end 17 of the handle section 15 and having a distal or tip end 25; and a second limb 27 having a proximal end 29 for being attached to the second end 19 of the handle section 15 and a distal or tip end 31. The limbs 21, 27 preferably extend substantially symmetrically from the handle section 15. A bowstring 33 extends generally between the tip ends 25, 31 of the first and second limbs 21, 27. The bow 11 preferably consists of a compound bow and preferably includes an eccentric pulley member 35 rotatably attached to each tip end 25, 31 by an axle 36 or the like and around which the bowstring 33 is trained whereby less force will be required to hold the bowstring 33 in a fully drawn position than to hold the bowstring 33 at an intermediate drawn position as will now be apparent to those skilled in the art and as indicated by FIG. 3. Also, a pair of idler wheels are preferably provided on handle section 15. It will be understood that the idler wheels per se, which are well known to those skilled in the art, are not shown but only the axles thereof can be seen in FIGS. 1 and 2 as at 36.

The bow 11 includes assist means 37 for reducing the amount of force required to draw the bowstring 33 to a full draw while maintaining the arrow velocity produced when said bowstring 33 is released. The preferred embodiment of the assist means 33 includes force multiplication means 39 for multiplying the force applied to the bow 11 as the bow 11 is drawn and for applying that multiplied force to the distal ends 25, 31 of the limbs 21, 27 to tension the limbs 21, 27. The force multiplication means 39 preferably includes pulley means 41 rotatably mounted by way of an axle 43 or the like to the handle section 15 with the bowstring 33 attached thereto in a manner that rotation of the pulley means 41 will draw the tip ends 25, 31 of the limbs 21; 27 toward one another to thereby aid in "tensing" the bow 11 as will now be apparent to those skilled in the art. The pulley means 41 is preferably located substantially midway between the tip ends 25, 31 of the limbs 21, 27. More specifically, the handle section 15 may include one or more lug members 45 to which the axle 43 is attached. The pulley means 41 preferably includes a first wheel 47, a second wheel 49, and a third wheel 51. Each wheel 47, 49, 51 preferably has a grooved rim 53. The first wheel 47 is preferably substantially larger in diameter than the second and third wheels 49, 51. The bowstring 33 preferably extends about at least a portion of the second and third wheels 49, 51 and is preferably fixedly attached thereto in a manner which will hereinafter be explained. The wheels 47, 49, 51 may be constructed as a one-piece, integral unit as by being machined out of a single piece of metal or the like as clearly shown in the drawings.

Figure 1:
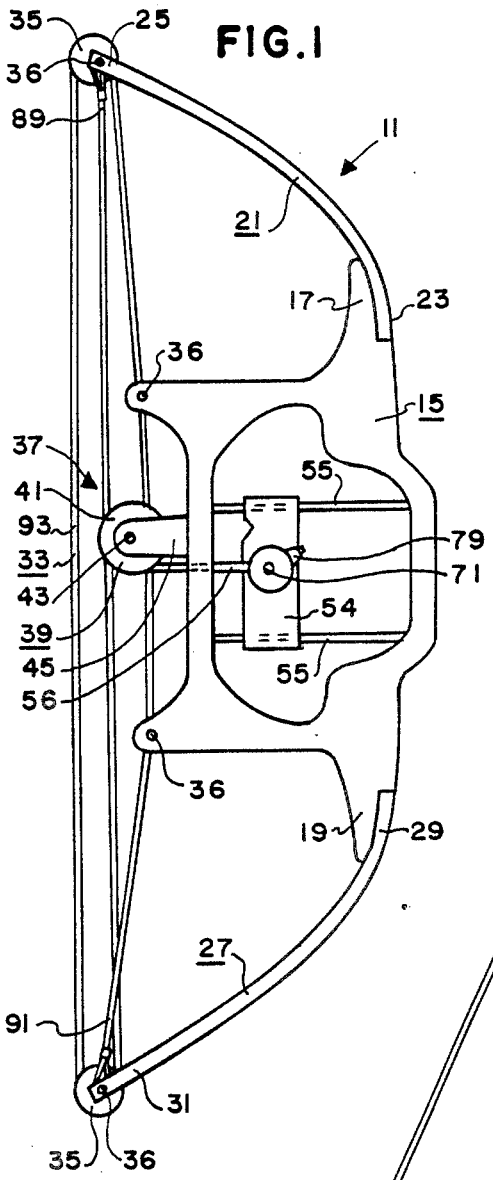
FIG. 1 is a side elevation of an archery bow embodying the teachings of the present invention showing the bow in an at-rest position.
Figure 2:
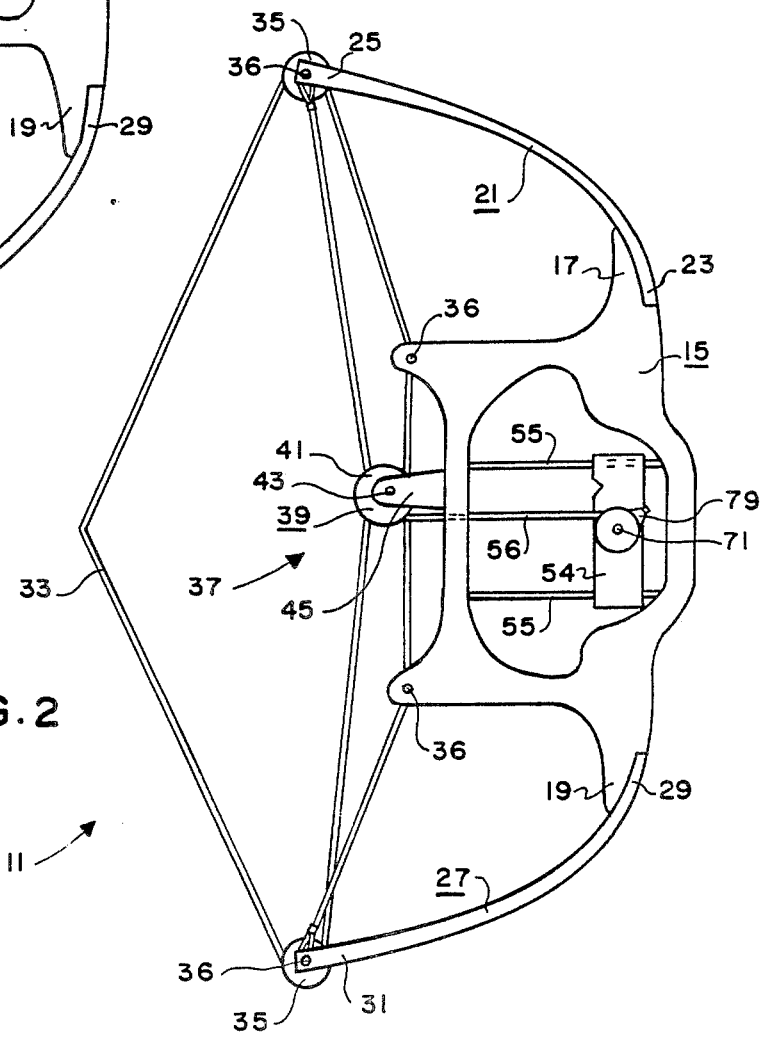
FIG. 2 is a side elevation of an archery bow embodying the teachings of the present invention showing the bow in a fully drawn position.

The assist means 37 preferably includes a grip member 54 slidably mounted on the handle section 15 by rails 55 or the like for movement between a first position when the bow 11 is in an at-rest position as shown in FIG. 1 and a second position when the bow is in a fully drawn position as shown in FIG. 2. The grip member 54 may include a typical arrow rest portion (not shown) for supporting the forward end of the arrow (not shown) as the bow 11 is used as will now be apparent to those skilled in the art.

Figure 4:
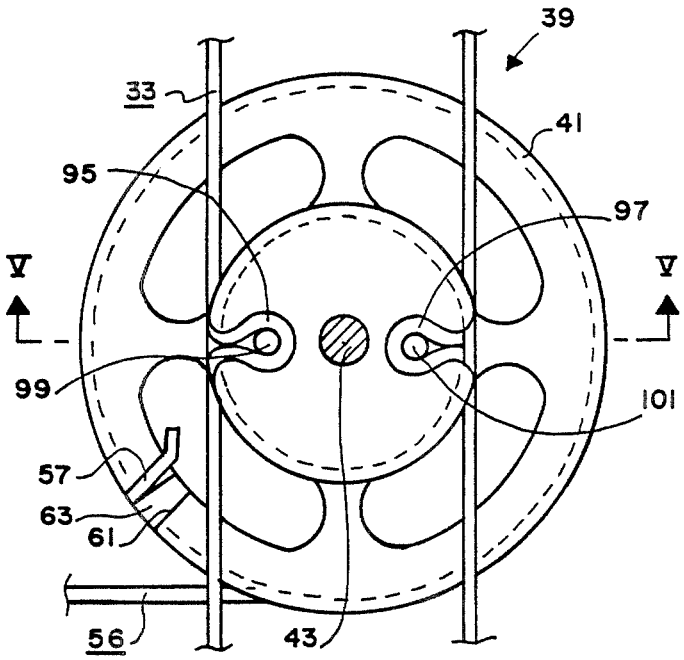
FIG. 4 is a somewhat diagrammatic sectional view of a pulley means and associated structure of an archery bow embodying the teachings of the present invention.

The assist means 37 preferably includes a cable means 56 extending between the pulley means 41 and the grip member 54 for causing the pulley means 41 to rotate when the grip member 54 moves from the first position to the second position. The cable means 56 thus coacts with the force multiplication means 39 to reduce the amount of force required to draw the bowstring 33 to a full draw while maintaining the arrow velocity produced when said bowstring 33 is released. The cable means 56 preferably includes a first end 57 and a second end 59. The cable means 56 is preferably attached to the pulley means 41 at a point farther from the center of rotation of the pulley means 41 than the bowstring 33 to create a mechanical advantage when the pulley means 41 is rotated when the grip member 54 moves from the first position to the second position. Thus, the first end 57 of the cable means 56 preferably extends around at least a portion of the grooved rim 53 of the first wheel 47 and is fixedly attached to the pulley means 41. The first wheel 47 preferably includes a slot 61 for allowing a wedge 63 or the like to be used to secure the first end 57 of the cable means 56 thereto in a manner as will now be apparent to those skilled in the art and as clearly shown in FIG. 4. Since the first wheel 47 is larger in diameter than the second and third wheels 49, 51 to which the bowstring 33 is attached, rotation of the first wheel 47 will create a mechanical advantage in rotating the second and third wheels 49, 51 and drawing the tip ends 25, 31 of the limbs 21, 27 toward one another as will now be apparent to those skilled in the art.

Figure 6:
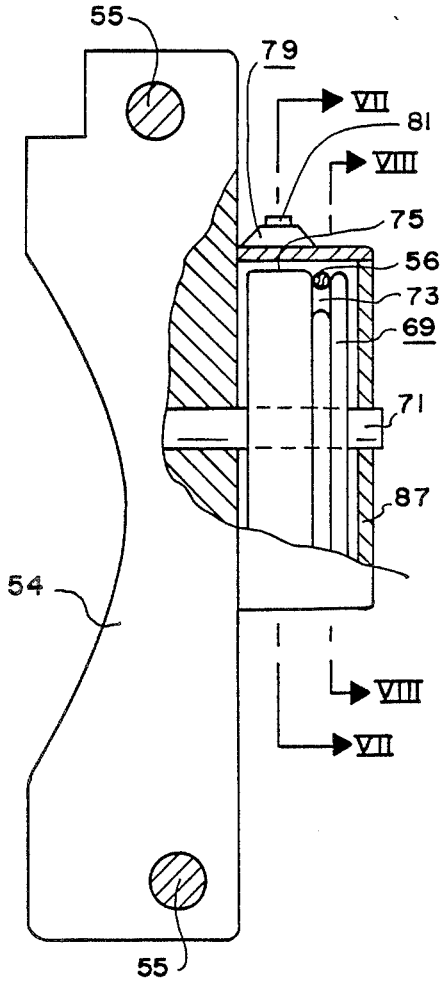
FIG. 6 is a somewhat diagrammatic sectional view of a handle portion and associated structure of an archery bow embodying the teachings of the present invention.
Figure 5:
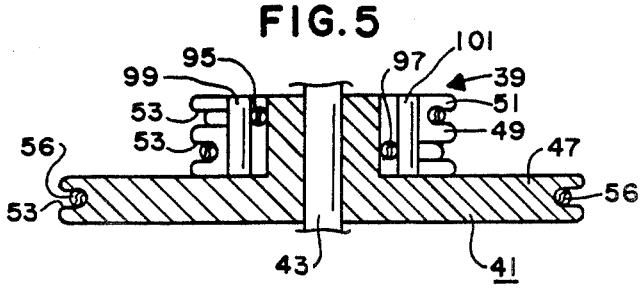
FIG. 5 is a sectional view as taken on line V—V of FIG. 4.
Figure 7:
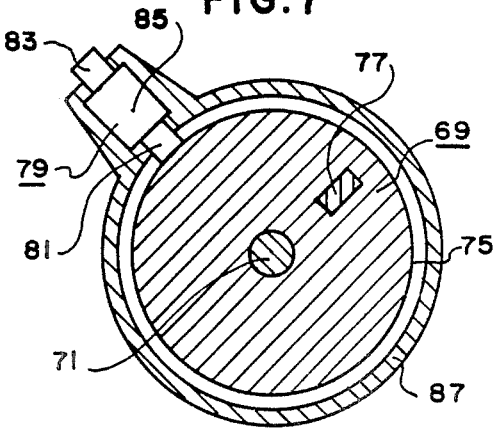
FIG. 7 is a sectional view as taken on line VII—VII of FIG. 6.
Figure 8:
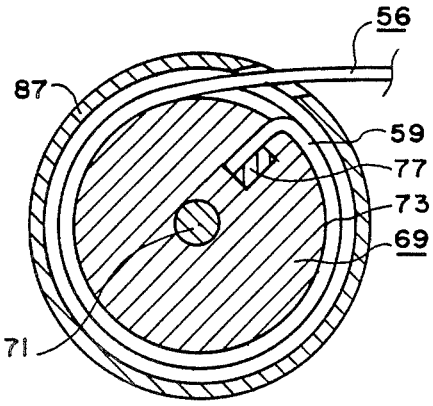
FIG. 8 is a sectional view as taken on line VIII—VIII of FIG. 6.

The assist means 37 preferably includes a pulley 69 rotatably attached to the grip member 54 by an axle 71. The rim of the pulley 69 preferably has a grooved portion 73 and a flat ungrooved cylindrical portion 75. The second end 59 of the cable means 56 preferably extends around at least a portion of the grooved rim 73 of the rim of the pulley 69 and is preferably fixedly attached thereto by a wedge 77 or the like. The assist means 37 preferably includes brake means 79 for selectively preventing the pulley 69 from rotating. The brake means 79 may include a pad portion 81 for frictionally engaging the flat portion 75 of the rim of the pulley 69 and an activating switch or button 83 which can be activated by the user of the bow 11 to selectively prevent or allow rotation of the pulley 69 (see, in general, FIG. 7). The brake means 79 may include some type of holding means 85 for holding the pad portion 81 against the flat portion 75 of the rim of the pulley 69. Thus, for example, the holding means 85 may be similar to the holding means 85 of many ball-point pens and the like as will now be apparent to those skilled in the art. A spring or the like, not shown, may be associated with the pulley 69 to lightly urge the pulley 69 to rotate and wind the second end 59 of the assist string 56 about the grooved portion 73. A cover 87 may be provided over the pulley 69 and associated structure as clearly shown in FIGS. 6–8.

The bowstring 33 has a first end 89, a second end 91, a midportion 93, a portion 95 between the first end 89 and the midportion 93, and a portion 97 between the second end 91 and the midportion 93. The first end 89 of the bowstring 33 is preferably attached to the distal or tip end 25 of the first limb 21 as by being looped about an axle 36 as will now be apparent to those skilled in the art. The second end 91 of the bowstring 33 is preferably attached to the distal or tip end 31 of the second limb 27 as by being looped about an axle 36 as will now be apparent to those skilled in the art. The portion 95 of the bowstring 33 preferably extends about at least a portion of the grooved rim 53 of the third wheel 51 and is preferably fixed thereto by an entrapment 99. The portion 97 of the bowstring 33 preferably extends about at least a portion of the grooved rim 53 of the second wheel 49 and is preferably fixed thereto by an entrapment 101. Each entrapment 99, 101 may consist merely of a winding passage in the pulley means 41 through which the appropriate portion of the bowstring 33 is trained in a manner which fixedly secures the bowstring 33 thereto in a manner which will now be apparent to those skilled in the art.

The operation of the bow 11 is quite simple. With the bow 11 in the at-rest position as shown in FIG. 1, an arrow (not shown) is "notched" on the midportion 93 of the bowstring 33 and placed on the typical rest portion (not shown) of the grip member 54, etc., as will now be apparent to those skilled in the art. The brake means 79 is then activated to prevent the pulley 69 from rotating and the bow 11 is drawn to the fully drawn position as shown in FIG. 2. As the bow 11 is drawn, the grip member 54 will be pushed forward relative to the pulley means 41 and, with the pulley 69 prevented from rotating, the cable means 56 will, in turn, cause the pulley means 41 to rotate. Rotation of the pulley means 41 will, in turn, apply a mechanical advantage to the deflection of the limbs 21, 27 thus reducing the amount of force required to draw the bow 11 to full draw. Once the bow 11 has been drawn to full draw but before or at the same time the arrow is released, the brake means 79 is deactivated to release the pulley 69 so that when the bow 11 is subsequently released, the full arrow velocity produced by the bow 11 will be substantially maintained (i.e., the majority of the force produced by the bow 11 will be used to propel the arrow and only a slight amount will be used to "unwind" the pulley 69 as will now be apparent to those skilled in the art).

Figure 9:
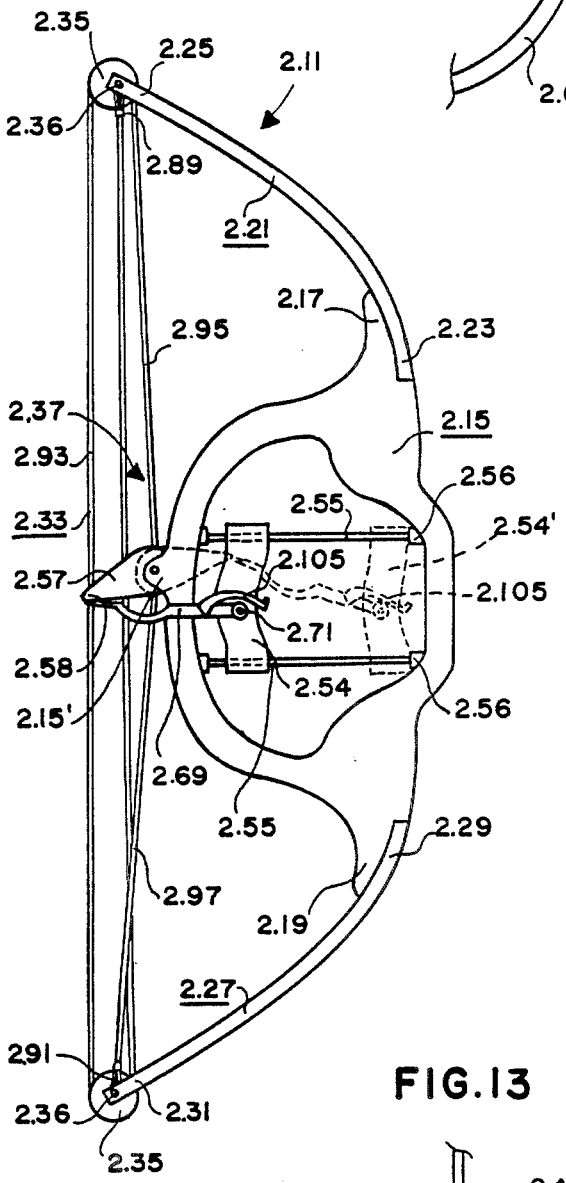
FIG. 9 is a side elevation of a second embodiment of the present invention showing the bow in solid lines in an at-rest position and showing in broken lines the position of certain parts of the bow when the bow is in a fully drawn position.

A second embodiment of the archery bow of the present invention is shown in FIGS. 9–13 and identified by the numeral 2.11. The bow 2.11 includes a handle portion or section 2.15 having in general a first end 2.17 and a second end 2.19; a first limb 2.21 having a proximal end 2.23 for being attached to the first end 2.17 of the handle section 2.15 and having a distal or tip end 2.25; and a second limb 2.27 having a proximal end 2.29 for being attached to the second end 2.19 of the handle section 2.15 and a distal or tip end 2.31. The limbs 2.21, 2.27 preferably extend substantially symmetrically from the handle section 2.15. A bowstring 2.33 extends generally between the tip ends 2.25, 2.31 of the first and second limbs 2.21, 2.27. The bow 2.11 preferably consists of a compound bow and preferably includes an eccentric pulley member 2.35 rotatably attached to each tip end 2.25, 2.31 by an axle 2.36 or the like and around which the bowstring 2.33 is trained whereby less force will be required to hold the bowstring 2.33 in a fully drawn position than to hold the bowstring 2.33 at an intermediate drawn position as will now be apparent to those skilled in the art. Bowstring 2.33 is preferably crossed at the lower part thereof as shown in FIG. 9 and in a manner well known to those skilled in the art. Pulley members 2.35 are designed in a manner now known to those skilled in the art to compensate for cable angle. Also, the bow 2.11 is preferably designed so that the force and velocity that the arrow is propelled thereby is 28% greater than the force required to fully draw the bow 2.11. It should be understood that the bow 2.11 may be designed so that the specific difference between the arrow velocity and bow draw pull is greater or lesser than 28%.

The bow 2.11 includes assist means 2.37 for reducing the amount of force required to draw the bowstring 2.33 to a full draw while maintaining the arrow velocity produced when bowstring 2.33 is released. The assist means 2.37 includes force multiplication means 2.39 for multiplying the force applied to the bow 2.11 as the bow 2.11 is drawn and for applying that multiplied force to the distal ends 2.25, 2.31 of the limbs 2.21, 2.27 to tension the limbs 2.21, 2.27. The force multiplication means 2.39 preferably includes pulley means 2.41 rotatably mounted by way of an axle 2.43 or the like to the handle section 2.15 with the bowstring 2.33 attached thereto in a manner that rotation of the pulley means 2.41 will draw the tip ends 2.25, 2.31 of the limbs 2.21, 2.27 toward one another to thereby aid in "tensing" the bow 2.11 as will now be apparent to those skilled in the art. The pulley means 2.41 is preferably located substantially midway between the tip ends 2.25, 2.31 of the limbs 2.21, 2.27. More specifically, the handle section 2.15 preferably projects outwardly as at 2.15' to which the axle 2.43 is attached. The pulley means 2.41 preferably includes a pair of wheels 2.47, 2.49. Each wheel 2.47, 2.49 preferably has a grooved rim 2.53. The wheels 2.47, 2.49 are preferably of the same diameter. The bowstring 2.33 preferably extends about at least a portion of the wheels 2.47, 2.49 and is preferably fixedly attached thereto in a manner which will hereinafter be explained.

The assist means 2.37 preferably includes a grip member 2.54 slidably mounted on the handle section 2.15 by rails 2.55 or the like for movement between a first position shown in solid lines in FIG. 9 when the bow 2.11 is in an at-rest position and a second position shown in broken lines in FIG. 9 as at 2.54' when the bow is in a fully drawn position. A pair of stops 2.56 are preferably provided on rails 2.55 adjacent handle section 2.15 for stopping grip member 2.54 in said second position. It will be understood that in FIG. 9 the position of the bow string 2.33 and limbs 2.21, 2.27, when the bow 2.11 is in the fully drawn position, have not been shown. The grip member 2.54 may include a typical arrow rest portion (not shown) for supporting the forward end of the arrow (not shown) as the bow 2.11 is used as will now be apparent to those skilled in the art.

Figure 10:
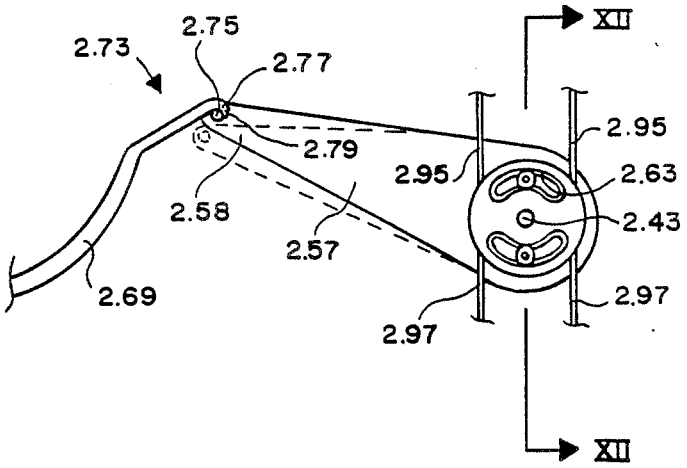
FIG. 10 is an enlarged elevation view of certain parts of said second embodiment as seen from the opposite side of the bow from that shown in FIG. 9 and with parts being broken away for purposes of illustration and with the parts being shown in the position in which they are in when the bow is in a substantially fully drawn position.
Figure 12:
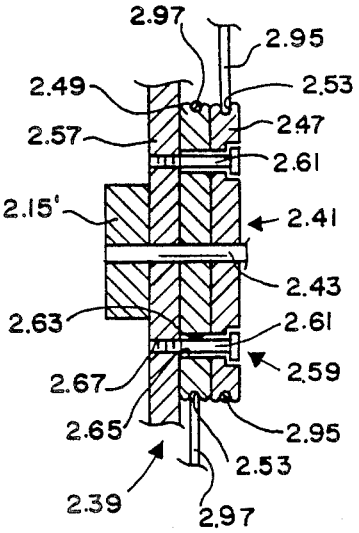
FIG. 12 is an enlarged view as taken on the line XII—XII of FIG. 10.
Figure 13:
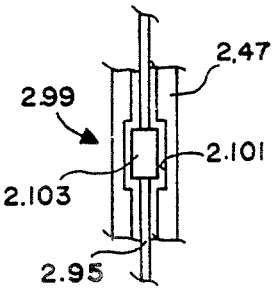
FIG. 13 is a somewhat diagrammatic fragmentary view showing a means of entrapment of the bowstring for the attachment thereof.

The force multiplication means 2.39 also includes lever means 2.57 attached to the pair of wheels 2.47, 2.49 for rotation of the pair of wheels 2.47, 2.49 upon rotation of lever means 2.57. Lever means 2.57 extends outwardly beyond wheels 2.47, 2.49 and terminates in a distal end 2.58. Lever means 2.57 and wheels 2.47, 2.49 are preferably adjustably mounted relative to one another by an adjustment means 2.59 for changing the position of lever means 2.57 and wheels 2.47, 2.49 relative to one another for adjustment of bow 2.11. More specifically, lever means 2.57 is preferably rotatably mounted to the handle section 2.15 on the same axle 2.43 as wheels 2.47, 2.49 with lever means 2.57 being on the inside adjacent handle section 2.15, wheel 2.47 being on the outside remote from handle section 2.15, and wheel 2.49 being sandwiched between wheel 2.47 and lever means 2.57. When in an unlocked condition, lever means 2.57 and wheels 2.47, 2.49 are movable along axle 2.43, and lever means 2.57 and wheels 2.45, 2.49 are rotatable relative to one another. A bolt 2.61 extends through arcuate slots 2.63 and 2.65 respectively provided in wheels 2.47, 2.49 and is threadedly engaged in a threaded bore 2.67 provided in lever means 2.57 to unlock and lock the lever means 2.57 and wheels 2.47, 2.49 relative to one another. Preferably another bolt 2.61 and related slots 2.63, 2.65 like the above described bolt and slots are provided. Bolts 2.61 may be unscrewed partially to loosen lever means 2.57 and wheels 2.47, 2.49 relative to one another so that the proper adjustment can be made and then the bolts 2.61 may be tightened to maintain lever means 2.57 and wheels 2.47, 2.49 fixed relative to one another. It will be understood that when bolts 2.61 are tightened, the lever means 2.57 and wheels 2.47, 2.49 will be tightly drawn together by bolts 2.61 so that friction holds them in a fixed position relative to one another. The outer face of wheel 2.47 is preferably recessed adjacent slots 2.63 to accommodate the heads of bolts 2.61 as best seen in FIGS. 10 and 12.

The assist means 2.37 preferably includes a preferably rigid rod means 2.69 pivotally attached to grip member 2.54 as at 2.71 by suitable means now known to those skilled in the art, and cooperating latch means 2.73 including first latch means 2.75 on lever means 2.57 and second latch means 2.77 on rod means 2.69 for engaging first latch means 2.75 to rotate pulley means 2.41 when grip member 2.54 moves from said first position shown in solid lines in FIG. 9 to said second position shown as at 2.54'.

First latch means 2.75 is preferably button-like in form and is fixedly attached to lever means 2.57 adjacent the distal end 2.58 thereof. Second latch means 2.77 is preferably in the form of a depending hook 2.79 which is provided at the distal end of rod means 2.69 and is adapted to engage or hook over first latch means 2.75 as for example as is shown in solid lines in FIG. 10.

The first latch means 2.75 is farther from the center of rotation of pulley means 2.41 and lever means 2.57 (i.e., axle 2.43) than are the rims 2.53 of wheels 2.47, 2.49 whereby a mechanical advantage is created when pulley means 2.41 and lever means 2.57 are rotated when grip member 2.54 moves from said first position to said second position. The rod means 2.69 thus coacts with the force multiplication means 2.39 to reduce the amount of force required to draw the bowstring 2.33 to a full draw while maintaining the arrow velocity produced when said bowstring 2.33 is released.

The bowstring 2.33 has a first end 2.89, a second end 2.91, a midportion 2.93, a portion 2.95 between the first end 2.89 and the midportion 2.93, and a portion 2.97 between the second end 2.91 and the midportion 2.93. The first end 2.89 of the bowstring 2.33 is preferably attached to the distal or tip end 2.25 of the first limb 2.21 as by being looped about an axle 2.36 as will now be apparent to those skilled in the art. The second end 2.91 of the bowstring 2.33 is preferably attached to the distal or tip end 2.31 of the second limb 2.27 as by being looped about an axle 2.36 as will now be apparent to those skilled in the art. The portion 2.95 of the bowstring 2.33 preferably extends about at least a portion of the grooved rim 2.53 of the wheel 2.47, i.e. adjacent the lower half of the wheel 2.47 and is preferably fixed thereto by a suitable entrapment 2.99. If desired the entrapment 2.99 may be in the form shown in FIG. 4, i.e. entrapment 99, or in the form shown in FIG. 13 wherein it will be seen entrapment 2.99 includes a socket 2.101 in the periphery of wheel 2.47 and a bead-like member 2.103 formed for example of metal which is fixed as by clamping onto bowstring portion 2.95. The portion 2.97 of the bowstring 2.33 preferably extends about at least a portion of the grooved rim 2.53 of the wheel 2.49, i.e. adjacent the upper half of the wheel 2.49 and is preferably fixed thereto by an entrapment 2.99 of a suitable form such as that shown in FIG. 13 or like entrapment 99 shown in FIG. 4.

Figure 11:
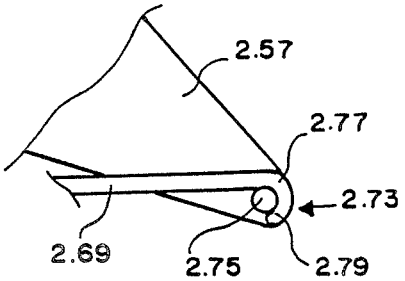
FIG. 11 is a fragmentary view of a portion of that shown in FIG. 9 but as seen from the opposite side thereof.

As with bow 11 the operation of bow 2.11 is quite simple. With the bow 2.11 is the at-rest position as shown in solid lines in FIG. 9, the depending hook 2.79 of rod means 2.69 is hooked over first latch means 2.75 by manually lifting the rod means 2.69 to move the hook 2.79 to a position above first latch means 2.75 and then allowing the hook 2.79 to drop down over the first latch means 2.75 for hooked engagement therewith as best seen in FIGS. 10 and 11. If desired, a rigid push member 2.105 may be fixedly provided on rod means 2.69 by suitable means as welding or the like or may be integrally formed thereon to aid in the manual positioning of rod means 2.69. Then, an arrow (not shown) is "notched" on the midportion 2.93 of the bowstring 2.33 and placed on the typical rest portion (not shown) of the grip member 2.54, etc., as will now be apparent to those skilled in the art. Next, the bow 2.11 is drawn to a fully drawn position and at the same time as the bow 2.11 is drawn the grip member 2.54 will be pushed forwardly from said first position shown in solid lines in FIG. 9 to said second position shown in broken lines as at 2.54' in FIG. 9. As grip member 2.54 is moved from said first position to said second position the pull on lever means 2.57 by rod means 2.69 causes lever means 2.57 to rotate counterclockwise as viewed in FIG. 9 from said first position shown in solid lines in FIG. 9 to said second position shown in broken lines in FIGS. 9 and 10. It will be understood that FIG. 10 shows the opposite side of lever means 2.57 from that shown in FIG. 9. Rotation of the lever means 2.57 as above described will, in turn, apply a mechanical advantage to the deflection of the limbs 2.21, 2.27 thus reducing the amount of force required to draw the bow 2.11 to full draw. Once grip member 2.54 reaches said second position thereof, i.e. when the grip member can go no farther because of stops 2.56 and the bow 2.11 is in a substantially full drawn position continued pull on the bow string 2.33 for a small amount will cause lever means 2.57 to move to an upper position shown in solid lines in FIG. 10 and raise rod 2.69 slightly therewith to an upper position as shown in solid lines in FIG. 10. Rod means 2.69 and hook 2.79 will remain in said upper position when the arrow is released due to suitable friction means, not shown, provided between rod means 2.69 and grip member 2.54 and well known to those skilled in the art. The fact that rod means 2.69 and hook 2.79 remains in said upper position permits the lever means 2.57 to move downwardly away from rod means 2.69 and disengage the cooperating latch means 2.73 when the bow string 2.33 is released so that lever means 2.57 can move back into its said first position shown in FIG. 9 while grip member 2.54 remains in its said second position shown in broken lines in FIG. 9.

Alternatively, if after the bow 2.11 has been moved to said substantially fully drawn position as heretofore described and it is decided not to shoot the arrow but let the bowstring be placed in an at-rest position the rod means 2.69 is manipulated manually as by means of the push member 2.105 to move rod means 2.69 downwardly from its said upper position to a securely engaged position with first latch means 2.75 whereby bowstring 2.33 may be slowly released to put the bow 2.11 back into said at rest position.

Although the present invention has been described and illustrated with respect to a preferred and a second embodiment thereof, it is not to be so limited since modifications and changes can be made therein which are within the full intended scope of the invention.

I claim:

1. An archery bow for propelling an arrow at a velocity depending on the draw strength of the bow, said bow comprising:

(a) a handle section having first and second ends;

(b) an elongated first limb having a proximal end attached relative to said first end of said handle section, and having a distal end;

(c) an elongated second limb having a proximal end attached relative to said second end of said handle section, and having a distal end;

(d) a bowstring extending between said distal ends of said first and second limbs;

(e) assist means for reducing the amount of force required to draw said bowstring to a full draw while maintaining the arrow velocity produced when said bowstring is released, said assist means including a grip member movably mounted on said handle section for movement away from said bowstring as said bow is drawn from a first position with said bow in an at-rest position to a second position with said bow in a substantially fully drawn position, movement of said grip member from said first position to said second position causing said distal ends of said first and second limbs to draw toward one another.

2. The bow of claim 1 in which said assist means includes force multiplication means for multiplying the force applied to the bow as the bow is drawn and for applying that multiplied force to said distal ends of said limbs to tension said limbs.

3. The bow of claim 2 in which said force multiplication means includes pulley means rotatably mounted to said handle section with said bowstring attached to said pulley means in a manner that rotation of said pulley means will draw said distal ends of said limbs toward one another.

4. An archery bow for propelling an arrow at a velocity depending on the draw strength of the bow, said bow comprising:

(a) a handle section having first and second ends;

(b) an elongated first limb having a proximal end attached relative to said first end of said handle section, and having a distal end;

(c) an elongated second limb having a proximal end attached relative to said second end of said handle section, and having a distal end;

(d) a bowstring extending between said distal ends of said first and second limbs;

(e) assist means for reducing the amount of force required to draw said bowstring to a full draw while maintaining the arrow velocity produced when said bowstring is released; said assist means including force multiplication means for multiplying the force applied to the bow as the bow is drawn and for applying that multiplied force to said distal ends of said limbs to tension said limbs; said force multiplication means including pulley means rotatably mounted to said handle section with said bowstring attached to said pulley means in a manner that rotation of said pulley means will draw said distal ends of said limbs toward one another; said assist means including a grip member slidably mounted on said handle section for movement between a first position with said bow in an at-rest position and a second position with said bow in a substantially fully drawn position.

5. The bow of claim 4 in which said assist means includes a cable means extending between said pulley means and said grip member for causing said pulley means to rotate when said grip member moves from said first position to said second position.

6. The bow of claim 5 in which said cable means has a first end and a second end with said first end attached to said pulley means at a point farther from the center of rotation of said pulley means than said bowstring to create a mechanical advantage when said pulley means is rotated when said grip member moves from said first position to said second position.

7. The bow of claim 6 in which said assist means includes a pulley rotatably attached to said grip member with said second end of said cable means attached thereto.

8. The bow of claim 7 in which said assist means includes brake means for selectively preventing said pulley from rotating.

9. The bow of claim 4 in which said pulley means includes a pair of wheels each having a rim and in which said force multiplication means includes lever means attached to said pair of wheels for rotation of said pair of wheels upon rotation of said lever means.

10. The bow of claim 9 in which said assist means includes rod means pivotally attached to said grip member, cooperating latch means including first latch means on said lever means and second latch means on said rod means for engaging said first latch means to rotate said pulley means when said grip member moves from said first position to said second position.

11. The bow of claim 10 in which said first latch means on said lever means is farther from the center of rotation of said pulley means and said lever means than said rims of said wheels whereby a mechanical advantage is created when said pulley means is rotated when said grip member moves from said first position to said second position.

12. The bow of claim 11 in which said first latch means includes a button-like member and in which said second latch means includes a hook adapted to removably engage said button-like member when said grip member moves from said first position to said second position.

13. The bow of claim 12 in which said bow includes stop means for stopping said grip member in said second position and with further pull on said bowstring after said grip member has reached said second position being effective to move said hook into an upper position in which said hook permits said lever means to disengage from said rod means while said grip member remains in its said second position.

14. The bow of claim 13 which includes a manually actuated push member fixedly attached to said rod means for manually moving said rod means from said upper position to a securely engaged position with said button-like member whereby said bowstring may be slowly released to put said bow back into an at-rest condition.

15. The bow of claim 14 in which adjustment means is provided coacting among said first wheel, said second wheel and said lever means for changing the positions of said wheels and said lever means relative to one another for adjustment of said bow.

16. An archery bow for propelling an arrow at a velocity depending on the draw strength of the bow, said bow comprising:

(a) a handle section having first and second ends;

(b) an elongated first limb having a proximal end attached relative to said first end of said handle section, and having a distal end;

(c) an elongated second limb having a proximal end attached relative to said second end of said handle section, and having a distal end;

(d) a bowstring extending between said distal ends of said first and second limbs;

(e) assist means for reducing the amount of force required to draw said bowstring to a full draw while maintaining the arrow velocity produced when said bowstring is released; said assist means including a grip member slidably mounted on said handle section for movement away from said bowstring as the bow is drawn from a first position with said bow in an at-rest position to a second position with said bow in a substantially fully drawn position, movement of said grip member from said first position to said second position causing said distal ends of said first and second limbs to draw toward one another.

* * * * *